US007988603B2

(12) United States Patent
Webber et al.

(10) Patent No.: US 7,988,603 B2
(45) Date of Patent: Aug. 2, 2011

(54) LEG PRESS EXERCISE MACHINE WITH SELF-ALIGNING PIVOTING SEAT

(75) Inventors: Randall T. Webber, La Jolla, CA (US); Christopher E. Brennan, Santee, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 12/872,816

(22) Filed: Aug. 31, 2010

(65) Prior Publication Data

US 2010/0323853 A1 Dec. 23, 2010

Related U.S. Application Data

(60) Continuation of application No. 12/045,985, filed on Mar. 11, 2008, now Pat. No. 7,878,953, which is a division of application No. 10/633,805, filed on Aug. 4, 2003, now Pat. No. 7,594,880.

(51) Int. Cl.
*A63B 21/00* (2006.01)

(52) U.S. Cl. ..... 482/96; 482/100; 482/130

(58) Field of Classification Search ..... 482/96, 482/95, 142, 130
See application file for complete search history.

(56) References Cited

U.S. PATENT DOCUMENTS 2,145,940 A 2/1939 Marlowe
3,116,062 A 12/1963 Zinkin
3,917,262 A 11/1975 Salkeld
4,149,714 A 4/1979 Lambert, Jr.
4,441,708 A 4/1984 Brentham
4,641,833 A 2/1987 Trethewey
4,743,010 A 5/1988 Geraci
4,790,530 A 12/1988 Maag
4,822,038 A 4/1989 Maag
4,844,456 A 7/1989 Habing et al.
4,917,379 A 4/1990 Maag
4,943,051 A 7/1990 Haskins et al.
4,944,641 A 7/1990 Alves
4,949,958 A 8/1990 Richey (Continued)

FOREIGN PATENT DOCUMENTS

CA 2075331 2/1994

OTHER PUBLICATIONS

Body Masters brochure, 2002, 1 page.

(Continued)

*Primary Examiner* — Jerome W Donnelly
(74) *Attorney, Agent, or Firm* — Procopio, Cory, Hargreaves & Savitch LLP

(57) ABSTRACT

A leg press machine has a floor engaging main frame, a user support pivotally mounted relative to the main frame and having primary and secondary support portions which support spaced locations on a user's body throughout an exercise, and a leg press exercise arm rotatably mounted relative to the main frame. The exercise arm has a first pivot connection which pivotally links the exercise arm to the user support and a second pivot connection which is associated with the main frame to link movement of the exercise arm to movement of the user support. A load resists movement of at least one of the moving parts.

19 Claims, 2 Drawing Sheets

U.S. PATENT DOCUMENTS 5,106,081 A 4/1992 Webb
5,254,067 A 10/1993 Habing et al.
5,263,914 A 11/1993 Simonson et al.
5,330,404 A 7/1994 Lopeteguy et al.
5,330,405 A 7/1994 Habing et al.
5,342,270 A 8/1994 Jones
5,352,171 A 10/1994 Lin
5,354,248 A 10/1994 Rawls et al.
5,356,358 A 10/1994 Chen
5,366,432 A 11/1994 Habing et al.
5,417,634 A 5/1995 Habing
5,453,066 A 9/1995 Richter, Jr.
5,478,298 A 12/1995 Chen
5,484,365 A 1/1996 Jones et al.
5,486,150 A 1/1996 Randolph
5,498,222 A 3/1996 Hur
5,505,679 A 4/1996 McBride et al.
5,520,599 A 5/1996 Chen
5,527,243 A 6/1996 Chen
5,527,250 A 6/1996 Chen
5,533,953 A 7/1996 Lui et al.
5,547,444 A 8/1996 Huang et al.
5,549,533 A 8/1996 Olson et al.
5,554,086 A 9/1996 Habing et al.
5,573,482 A 11/1996 Wang et al.
5,580,340 A 12/1996 Yu
5,582,563 A 12/1996 Fan
5,616,107 A 4/1997 Simonson
5,626,542 A 5/1997 Dalebout et al.
5,628,715 A 5/1997 Simonson
5,643,147 A 7/1997 Huang
D383,814 S 9/1997 Ward
5,669,865 A 9/1997 Gordon
5,674,161 A 10/1997 Lin
5,695,435 A 12/1997 Dalebout et al.
5,702,328 A 12/1997 Mansvelt
5,720,695 A 2/1998 Eckmann
5,722,918 A 3/1998 Lee
5,749,813 A 5/1998 Domzalski
5,810,698 A 9/1998 Hullett et al.
5,899,836 A 5/1999 Chen
5,938,570 A 8/1999 Maresh
5,944,641 A 8/1999 Habing
5,961,427 A 10/1999 Habing et al.
5,961,428 A 10/1999 Webber
6,004,247 A 12/1999 Webber
6,142,914 A 11/2000 Crawford et al.
6,162,153 A 12/2000 Perez et al.
6,220,993 B1 4/2001 Sencil
6,264,588 B1 7/2001 Ellis
6,287,241 B1 9/2001 Ellis
6,312,366 B1 11/2001 Prusick
6,319,178 B1 11/2001 Webber
6,605,024 B2 8/2003 Stearns
D481,428 S 10/2003 Giannelli et al.
6,659,919 B2 12/2003 Deola
6,676,577 B2 1/2004 Stearns
6,743,158 B2 6/2004 Giannelli et al.
6,752,748 B1 6/2004 Scotti
6,811,522 B1 11/2004 McQuinn
6,855,098 B2 2/2005 Reitz et al.
6,916,278 B2 7/2005 Webber
6,971,978 B2 12/2005 Hyder
7,052,444 B2 5/2006 Webber
7,052,446 B2 5/2006 Morris et al.
7,070,545 B2 7/2006 Lull et al.
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,331,911 B2 2/2008 Webber et al.
7,335,140 B2 2/2008 Webber et al.
7,361,125 B2 4/2008 Webber et al.
7,384,381 B2 6/2008 Webber et al.
7,468,024 B2 12/2008 Webber et al.
7,553,263 B2 6/2009 Webb et al.
7,594,880 B2 * 9/2009 Webber et al. ..... 482/96
2002/0183173 A1 12/2002 Abelbeck
2002/0187879 A1 12/2002 Ball et al.
2003/0199362 A1 10/2003 Chamberlin
2005/0032611 A1 2/2005 Webber et al.
2006/0247107 A1 11/2006 Carter
2006/0276313 A1 12/2006 Hong
2007/0232462 A1 10/2007 Webber et al.
2007/0232467 A1 10/2007 Puzey
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0234110 A1 9/2008 Webber et al.
2008/0242517 A1 10/2008 Webber et al.
2008/0248929 A1 10/2008 Webber et al.

OTHER PUBLICATIONS

Hoist brochure, 1993, 1 page.
Hoist HLP brochure, 1998, 1 page.
Keiser brochure, 1999, 1 page.
Gym 80 brochure, 2001, 1 page.
Paramount selectorized unit, 2000, 1 page.
Paramount plate loaded unit, 2002, 1 page.
Tuff Stuff brochure, date unknown.
Schwinn Natural Strength, Schwinn magazine ad, date unknown.

* cited by examiner

LEG PRESS EXERCISE MACHINE WITH SELF-ALIGNING PIVOTING SEAT

RELATED APPLICATION

The present application is a Continuation of co-pending U.S. patent application Ser. No. 12/045,985 filed on Mar. 11, 2008, which is a Divisional of U.S. patent application Ser. No. 10/633,805 filed on Aug. 4, 2003, which issued as U.S. Pat. No. 7,594,880 on Sep. 29, 2009, and the contents of each of the aforementioned applications are also incorporated herein by reference in their entirety.

BACKGROUND

1. Field of the Invention

This invention relates generally to exercise machines, and is particularly concerned with a lower body exercise machine such as a leg press exercise machine.

2. Related Art

The most widely performed free weight exercise for the lower body is the barbell squat. It is a compound movement exercise, requiring the movement of multiple joints, specifically the knee and hip, and multiple body parts, specifically the upper and lower legs. To perform the exercise, an exerciser stands erect, places a weighted bar across their shoulders and bends at the knees, squatting downward until the upper thighs are parallel to the floor. During the exercise, it is important to maintain a certain body alignment. The head should be upright, eyes looking forward; feet should be approximately shoulder width apart; the back should remain straight; and the knees should point forward and be positioned over the toes in the squat or low position of the exercise movement. Balance is a critical part of the exercise as unwanted front to back or side to side movement could create instability and disrupt alignment, which in turn could result in injury.

The leg press machine was designed to provide a safer squatting exercise by eliminating the problem of balance and stability. These machines reverse the start and finish positions by placing the user in the compressed or squat position at the start of the exercise and in the extended position with their legs straight at the finish. One version of a leg press consists of a stationary user support with a movable exercise arm. The user either sits upright or reclines in a prone or semi-prone position, places their feet upon a footplate attached to the exercise arm and pushes the arm forward. A variation of this design has the footplate stationary and the user support movable. In both these scenarios, the movement of the user support or exercise arm could be arcuate or linear.

While the movement is similar to a free weight squat, these leg press machines do not provide the same body alignment or positioning because they do not adjust the position of the user to the position of the footplate during the exercise movement. During a free weight squat, the body is constantly making minor adjustments to keep the feet, knees and back in proper alignment. This adjustment does not take place just at the beginning or end of the exercise; it happens continuously throughout the entire movement and, although balancing a bar on ones shoulders while bending at the knees can be tricky, it forces core stabilizing muscles in the abdomen and low back to be involved. Leg press machines that utilize a pivoting exercise arm can cause an exaggerated arcing movement during the exercise. An unnatural straight line movement is produced in leg press machines that utilize a linear movement exercise arm. Neither of these exercise machines provides body positioning equivalent to that of a free weight, barbell squat.

SUMMARY

A leg press exercise machine in one embodiment comprises a floor engaging main frame, a user support pivotally mounted relative to the main frame, a pivotally mounted leg press exercise arm having at least one user engaging footplate, and a connecting linkage which links movement of the user exercise arm to movement of the user support. A load provides resistance to movement of the user support, exercise arm and/or connecting linkage. The connecting linkage and pivot mounts are arranged so that pivotal movement of the exercise arm results in self-aligning movement of the user support. All movements of the leg press exercise arm, connecting linkage, and user support throughout a leg press exercise are rotational.

The user support comprises primary and secondary supports which support spaced positions on a user's body throughout an exercise. In one embodiment, the primary support is a back pad which is horizontal or close to horizontal in an exercise start position, and the user is supported in a supine position while performing a leg press exercise. The leg press exercise arm and user support rotate in the same direction throughout an exercise, and the primary support is inclined upwardly in the end position. The secondary support may comprise a head support pad, shoulder support pads, or both head and shoulder support pads, and in one embodiment comprises a secondary support assembly movably mounted on the user support to allow the secondary support position to be adjusted to accommodate users of different heights or leg lengths. Handles may also be provided on the secondary support assembly for gripping by a user while performing leg press exercises.

The leg press exercise machine places the user in a back supported starting position with their feet, knees and hips in a predetermined alignment, then adjusts that position, following the natural pivoting movement of the ankles, knees and hips as the users legs straighten, replicating the motion of a squat exercise. This combined movement of seat and exercise arm provides a more natural feeling exercise motion that constantly adjusts the position of the user during the exercise. Because the user support moves in conjunction with the exercise arm, the arcuate path of the exercise arm relative to the user support is reduced. The result is a more natural feeling exercise movement that more closely replicates the movement found in the corresponding free weight exercise.

In one embodiment, the user support pivot axis defines a vertical gravitational center line, and a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the pivoting mechanism's gravitational center line, resulting in either a high initial lifting resistance, or else a resistance "drop off" at the end of the exercise.

In one embodiment, the exercise arm is pivotally associated with a forward end of the user support at a first pivot connection, and the connecting linkage is pivotally attached to the exercise arm at a second pivot connection. The second pivot connection may be spaced above the first pivot connection.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

In one embodiment, the connecting linkage comprises a rigid linkage system and has at least one rigid connecting link located below a user engaging part of the user support in at least one of the exercise start and end positions. The connecting linkage is pivotally associated with the main frame with the rigid connecting link extending from the exercise arm to the main frame.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a leg press exercise machine having an exercise arm and user support which travel in a dependent relationship. The leg press exercise machine in the embodiments disclosed herein is designed to provide a pivoting user support which automatically aligns with movement of the exercise arm and which provides appropriate positioning of the user throughout the entire exercise movement.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
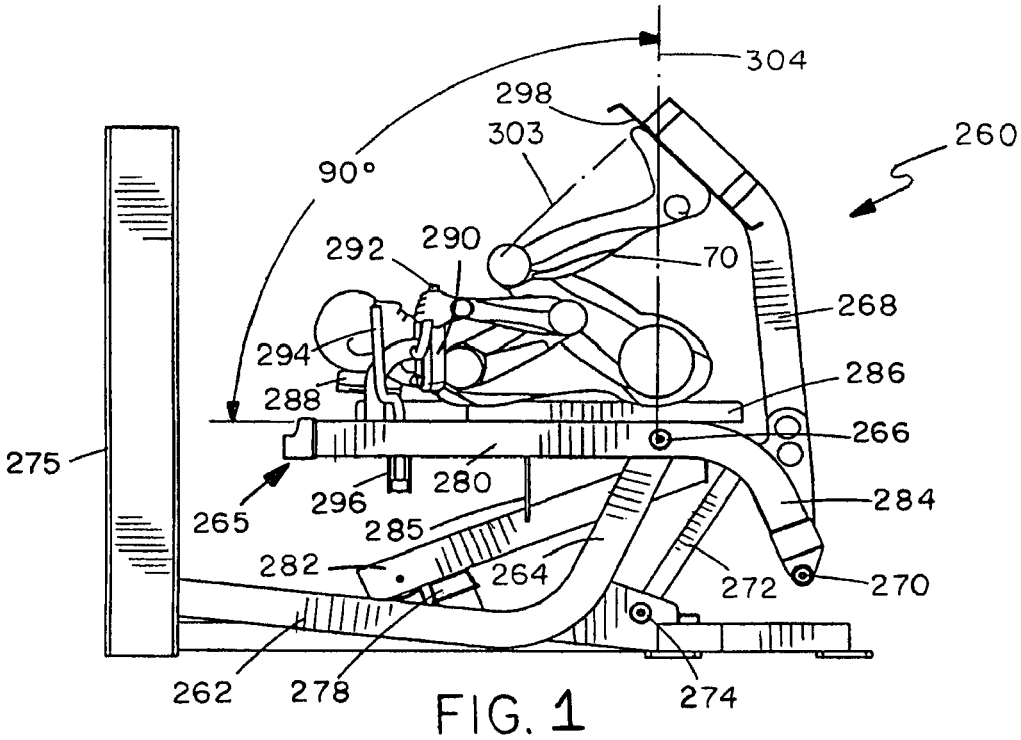
FIG. 1 is a side elevation view of one embodiment of a leg press exercise machine for performing squat type leg press exercises, with the machine illustrated in a start position adopted at the beginning of an exercise movement and the user in the start position on the machine.
Figure 2:
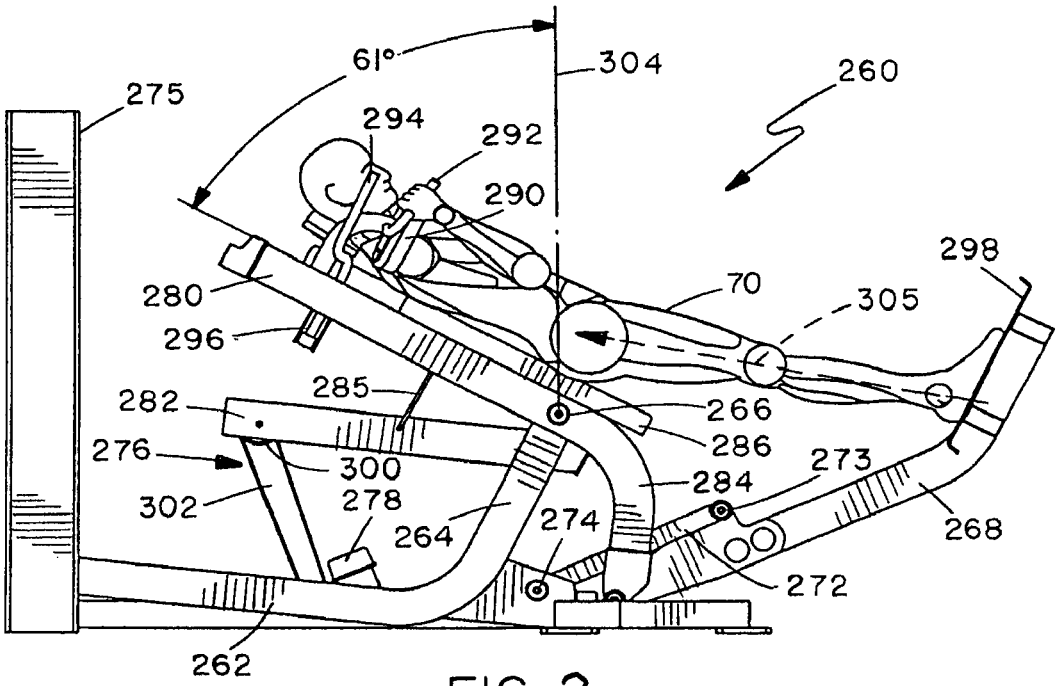
FIG. 2 is a side elevation view similar to FIG. 1, illustrating the user and machine in an exercise end position.
Figure 3:
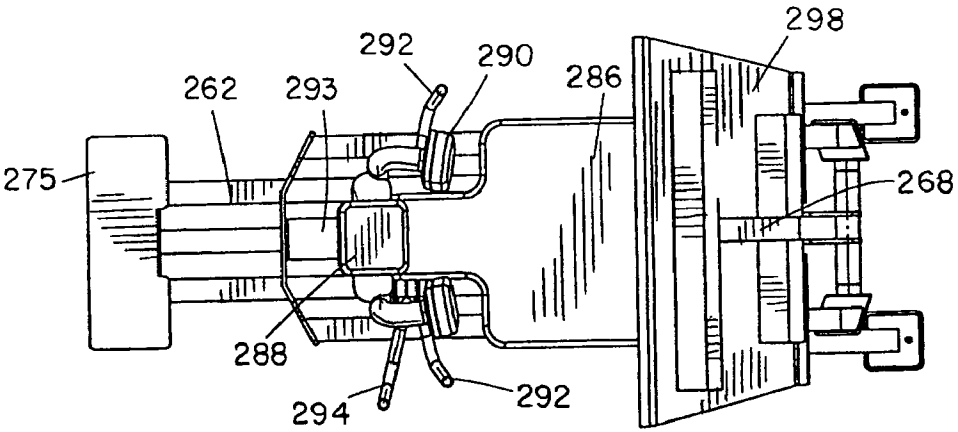
FIG. 3 is a top plan view of the machine of FIGS. 1 and 2, illustrating the position at the start of the exercise.
Figure 4:
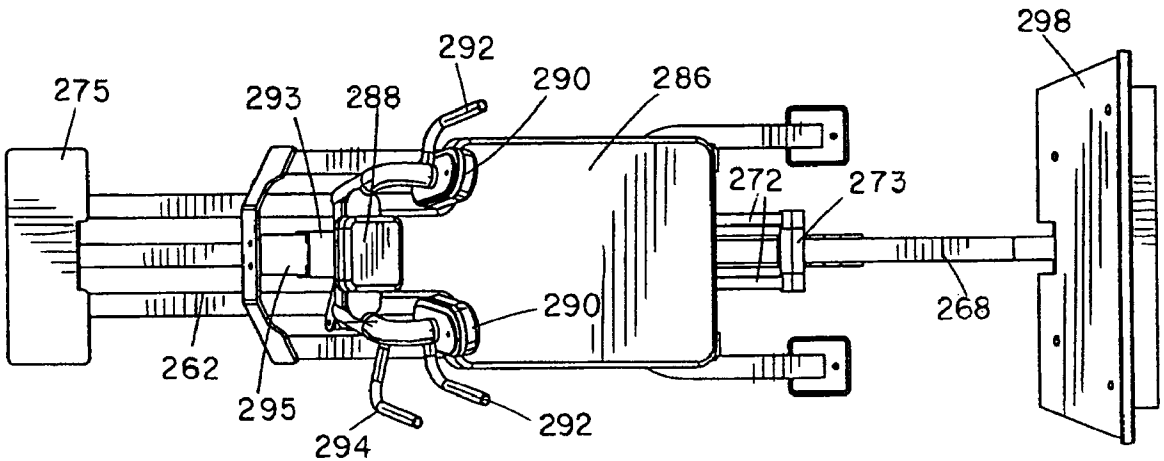
FIG. 4 is a top plan view similar to FIG. 3, illustrating the machine position at the end of the exercise.

'FIGS. 1 to 4 illustrate a leg press exercise machine 260 for performing squat type leg press exercises with the user in a prone or supine position at the start of the exercise, as illustrated in FIG. 1. FIG. 2 illustrates the end position of the user and machine, with the user's torso inclined upwardly relative to the start position of FIG. 1. FIGS. 3 and 4 illustrate top plan views of the machine in the start and end position, without the user.

The machine 260 has a main frame, a user support frame 265, and a leg exercise arm 268. The main frame comprises a horizontal base section 262 which engages the floor and a pivot mount section 264. The exercise arm 268 has a lower end pivoted to the forward end of the user support frame 265 at a first pivot connection 270. The user support frame has a second pivot connection 266 to pivot mount section 264 on the main frame. The exercise arm 268 has a user engaging foot plate 298 secured at its upper end. The exercise arm 268 has a second pivot connection 273 to a connecting linkage 272 which pivotally connects the exercise arm to the base section 262 of the main frame via pivots 273,274 at opposite ends of linkage 272, so that forward rotational movement of the arm 268 results in upward rotational movement of the user support. In the illustrated embodiment, the connecting linkage is a single rigid link, but may comprise more than one part in alternative embodiments.

The user support frame 265 is linked to an exercise resistance, in this case a selectorized weight stack in housing 275, via a cable and pulley mechanism 276, only part of which is visible in the drawings. The cable and pulley linkage 276 includes a pulley 300 at the rear end of the lower support 282 of the user support, and a cable 302 which extends around pulley 300 from an anchor (not visible) on the frame, and then extends rearward into the weight stack housing for linking to the weight stack in a conventional manner. Other moving parts of the machine may be linked to the exercise resistance in alternative embodiments, and other types of exercise resistance may be used in place of the weight stack. A support post or stop 278 on the base section of the frame beneath the user support 265 provides a rest for a rear portion of the user support in a rest position of the user support frame, as illustrated in FIG. 1.

The user support frame 265 is generally Y-shaped, with an upper support 280 and a lower support 282 extending rearward at an angle to the upper member. The upper support 280 has a downwardly curved portion 284 at its forward end which is pivotally secured to the exercise arm via pivot 270 at its lower end. A brace 285 extends between the upper and lower supports 280,282 at an intermediate point in their length for added support. A primary support back pad 286 is mounted on the upper support 280. A secondary support assembly comprising head rest 288, two shoulder pads 290, and two hand grips 292, is mounted at the rear end of the upper support. A user reclining on the back pad can place their feet on foot plate 298, as indicated in FIGS. 1 and 2. The connecting linkage 272 is located beneath the user engaging part of the user support 280 in at least the start position of a leg press exercise, as seen in FIG. 1.

The secondary support assembly is adjustably mounted on the upper support via sliding mount 293 which is slidably mounted on a central strut 295 of the upper support 280 as seen in FIG. 4, and secured in a selected position via a spring loaded pull pin 296 (see FIGS. 1 and 2). Handle 294 is provided for adjusting the position of the secondary support assembly. This permits the spacing between the secondary support assembly and foot plate 298 to be adjusted for users with different leg lengths.

FIGS. 1 and 2 illustrate a user 70 performing a squat type or lying leg press exercise on the machine 260. The user first lies on the back pad with the machine in the start position of FIG. 1, with their shoulders braced against the shoulder pads 290, and places their feet on the foot plate 298. They then push the foot plate 298 forward. While performing the exercise, the user may also grab the handles 292 for added stability. The starting position of FIG. 1 places the user in a substantially horizontal, back supported position with their legs bent, thighs against the torso, and knees aligned with the toes, as indicated by dotted line 303. This corresponds to the squatted position of a free barbell squat exercise, without the difficulty in balance and coordination in reaching this position when standing. The vertical dotted line 304 in FIGS. 1 and 2 represents the vertical centerline extending through the user support pivot axis 266, which is also the gravitational centerline of the user performing the exercise.

As indicated in FIG. 1, the user support backrest starts at an angle of 90 degrees to the vertical centerline 304, i.e. in a horizontal or substantially horizontal orientation. When the exercise arm 268 is pushed forward by the user pushing against the foot plate 298, the connecting link 272 pulls the pivot connection point 270 between the exercise arm and user support downward, which in turn forces the user support to rotate about its pivotal connection 266 to the main frame in the same direction as the exercise arm. This also moves the user from a horizontal to an upwardly inclined orientation, with their legs straight out along line 305 and slightly angled to the upper torso, and resistive force directed up the legs to the hips. This is similar to the standing position of a standing squat exercise, but with the slight angle of the user's torso taking pressure of the lower back. This exercise therefore closely mimics the movement of a standing squat type exercise, but without the risk of strain to the exerciser's lower back, since the resistive force directed to the hips and the back is properly supported. This eliminates or reduces spinal compression and improper lower back arching, providing a safer, more comfortable exercise.

The connecting linkage joins the exercise arm to the main frame, and the exercise arm is pivotally mounted on the user support. Thus the exercise arm is mounted to, and travels with, the user support. However, it is still directly linked to the main frame via the connecting link. This linkage connection controls the movement of the exercise arm and ultimately the movement of the user support, maintaining the automatic and continuous adjustment and alignment between the user support and exercise arm.

The user support pivot 266 is positioned directly under the exerciser and the gravitational centerline 304 extending through pivot 266 runs very close to the centerline of the user's hips in the start position of FIG. 1, allowing a balanced portion of both the user support and exerciser to be positioned on each side of the gravitational centerline. At the end of the exercise, the user is raised to approximately 61 degrees to the vertical with a portion of the weight of the user support, user, and exercise arm on opposite sides of vertical gravitational center line 304. As illustrated in FIGS. 1 and 2, a substantial portion of the combined weight of the user and the user support frame is positioned on each side of the gravitational center line 304 of the user support pivot axis in both the start and end position. The combined weight of the user and user support has a reduced effect on the amount of starting resistance, since part of the weight of the user and the user support is rearward of the user support pivot in the start position, acting as a counterbalance to the exercise arm. Because only a portion of the user and user support frame passes through the gravitational center line 304 during the exercise, a major drop off in resistance is not felt by the user during the exercise.

In the above embodiment, the exercise arm is pivoted directly to the user support and the connecting linkage pivotally links the exercise arm to the frame such that rotational movement of the arm results in rotational movement of the user support. The exercise machine 260 has a primary user support or back pad 286, a secondary user support (head support pad and shoulder pads), and an additional user support comprising hand grips 292, all of which remain in the same relative positions throughout the exercise movement.

In the exercise machine described above, operation of the leg press exercise arm causes a rocking movement of the user support. Due to the position of the user support pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

Any suitable connecting linkage may be used to link movement of the user engagement means to movement of the user support, and the connecting links could be made adjustable, and may be designed to push or pull, rotate or slide, and still force rotation of the user support. The user support and exercise arm can be designed to travel in the same or opposite directions, and the exercise arm and connecting link may travel in the same or opposite directions. The exercise resistance may be a weight stack linked to part of the apparatus by a cable and pulley arrangement, or may be weight plates mounted on pegs. Any other type of resistance known in the art may alternatively be used, such as hydraulic, pneumatic, electromagnetic, or elastic bands, in place of the weight stack or weight plates. The resistance may be associated with any of the moving parts, i.e. the user support, the exercise arm, or the connecting link.

Different types and forms of components may be used in place of those shown in the drawings. For example, cables could be replaced with belts, ropes, chains or any type of elongate, flexible member, and pulleys may be replaced by sprockets. The back pad and/or foot plate could be mounted to adjust in position or angle. The exercise arm could be one piece (dependent) or two pieces for independent arm movement, uni-directional or bi-directional, and may be mounted on the user support, main frame, or connecting link, and the exercise arm movement may be rotational or linear.

It should be understood that all the different elements used in the above embodiment may be mixed and interchanged with one another and still incorporate the essence of the above embodiments. The connecting linkage could be made adjustable and could push or pull to urge rotation of the user support which can be made to rotate forward or rearward. The resistance may be associated with any of the moving parts (user support, exercise arm or connecting linkage).

The above description of the disclosed embodiments is provided to enable any person skilled in the art to make or use the invention. Various modifications to these embodiments will be readily apparent to those skilled in the art, and the generic principles defined herein can be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A leg press exercise machine, comprising:

a main frame having a front end and a rear end;

a user support pivotally mounted for rotation about a user support pivot axis relative to the main frame, the user support pivot axis defining a predetermined user support rotational path about the user support pivot axis between a start position and an end position during a leg press exercise movement, the user support having a primary portion and a secondary portion which are configured to support spaced positions on a user's body throughout an exercise, the primary and secondary portions being fixed relative to one another and moving together in the same relative orientation to one another throughout the exercise movement;

the primary portion of the user support configured to support a user in a supine position at the start of the exercise movement;

a single leg press exercise arm rotatably mounted relative to the main frame and having a foot engaging device configured for engagement by the feet of a user positioned on the user support to perform a leg press exercise, the rotatable mount of the leg press exercise arm being configured to define a predetermined rotational leg press exercise path of the leg press exercise arm;

a connecting linkage which links movement of the leg press exercise arm to movement of the user support, the connecting linkage configured such that rotational movement of the leg press exercise arm in the predetermined leg press exercise path simultaneously rotates the user support about the user support rotational path;

the foot engaging device being at a higher elevation than both the primary and secondary portions of the user support through at least part of the leg press exercise path of the leg press exercise arm;

a load which resists movement of at least one of the user support, exercise arm, and connecting linkage; and wherein all movement of the leg press exercise arm, connecting linkage and user support throughout an exercise is rotational.

2. The machine of claim 1, wherein exercise movement of the leg press exercise arm simultaneously rotates the user support in the same direction as the leg press exercise arm.

3. The machine of claim 1, wherein the primary portion of the user support is substantially horizontal in the exercise start position.

4. The machine of claim 1, wherein the primary portion of the user support comprises a back pad which is configured to support the user's back and torso as the user support moves between a start position and an end position during a leg press exercise.

5. The machine of claim 4, wherein the secondary portion of the user support comprises head and shoulder rest pads.

6. The machine of claim 5, further comprising handles associated with the user support which are configured for gripping by a user during a leg press exercise.

7. The machine of claim 1, wherein the end position of the primary portion of the user support is upwardly inclined relative to the start position.

8. The machine of claim 1, wherein the user support pivot axis is located below the primary portion of the user support.

9. A leg press exercise machine, comprising:

a main frame having a front end and a rear end;

a user support pivotally mounted relative to the main frame to support a user in an exercise position and moving between a start position and an end position during a leg press exercise movement, the user support having a front end and a rear end, and a primary portion and a secondary portion which support spaced positions on a user's body throughout an exercise, the primary and secondary portions being fixed relative to one another and moving together in the same relative orientation to one another throughout the exercise movement;

a leg press exercise arm movably mounted relative to the main frame and configured to move in a first direction along a predetermined movement path during a leg press exercise, the leg press exercise arm comprising the only exercise arm movably mounted on the main frame, and having a foot engaging device which is engaged by the feet of a user positioned on the user support to perform a leg press exercise;

the user support having a first pivot connection linking the exercise arm with the forward end of the user support and a second pivot connection spaced from the first pivot connection and pivotally linking the user support with the main frame;

a connecting linkage which translates movement of the leg press exercise arm to movement of the user support, all movement of the connecting linkage being rotational; and a load which resists movement of at least one of the user support, exercise arm, and connecting linkage only when the leg press exercise arm moves in said first direction, whereby the leg press exercise arm is a unidirectional exercise arm and the exercise machine is configured for performance of lower body exercises only.

10. The machine of claim 9, further comprising at least one rigid connecting link which pivotally connects the exercise arm to the main frame, the second pivot connection pivotally connecting one end of the connecting link to the exercise arm.

11. The machine of claim 9, wherein the second pivot connection defines a vertical center line which extends through the primary portion of the user support in at least one of the start and end positions of an exercise movement.

12. The machine of claim 11, wherein the vertical center line extends through the primary portion of the user support in both the exercise start and end positions.

13. A leg press exercise machine, comprising:

a stationary main frame having a front end and a rear end;

a user support pivotally mounted relative to the main frame to support a user in an exercise position and moving about a user support pivot axis between a start position and an end position during a leg press exercise movement, the user support having a primary portion and a secondary portion which are configured to support spaced positions on a user's body throughout an exercise, the primary and secondary portions being fixed relative to one another and moving together in the same relative orientation to one another throughout the exercise movement;

a leg press exercise arm rotatably mounted relative to the main frame and having a foot engaging device configured for engagement by the feet of a user positioned on the user support to perform a leg press exercise, the leg press exercise arm having a pivot connection which pivotally links the leg press exercise arm with at least one of the user support and the main frame, the pivot connection defining a predetermined rotational path of movement of the leg press exercise arm about at least a first pivot axis;

a rigid connecting linkage system linking movement of the leg press exercise arm to movement of the user support, all movement of the connecting linkage system being rotational;

the first pivot axis being at a lower elevation than the foot engaging device during the entire rotational path of the leg press exercise arm about the first pivot axis; and a load which resists movement of at least one of the user support, exercise arm, and connecting linkage system.

14. The machine as claimed in claim 13, wherein the rigid connecting linkage system is linked to the main frame.

15. A leg press exercise machine, comprising:

a main frame;

a user support frame pivotally mounted relative to the main frame for rotation about a user support pivot axis, the user support pivot axis defining a vertical, gravitational center line and a horizontal line extending through the user support pivot axis transverse to the vertical, gravitational center line, the user support frame moving between a start position and an end position during an exercise movement;

the user support frame having at least a primary support and a secondary support configured to support spaced positions on a user's body throughout an exercise movement, the secondary support being fixed at a predetermined angular orientation relative to the primary support, the primary support configured to support the majority of a user's weight in the start position of the support frame, and the secondary support remaining in the same predetermined angular orientation relative to the primary support throughout an exercise movement;

a leg press exercise arm rotatably mounted on one of the frames and configured for engagement by the user in performing leg press exercises, the leg press exercise arm comprising the only exercise arm on the machine;

a connecting linkage which translates movement of the user engagement device to movement of the user support frame;

all movement of the user support frame, leg press exercise arm, and connecting linkage comprising rotational movement; and a load for resisting movement of at least one of the user support frame, leg press exercise arm, and connecting linkage, whereby the horizontal line is located below the entire user engaging part of the primary user support in at least one of the start and end positions of the exercise movement.

16. The machine of claim 15, wherein the leg press exercise arm is rotatably linked to a forward end of the user support.

17. The machine of claim 15, wherein the connecting linkage comprises at least one link arm located below the primary user support in at least one of the exercise start and end positions.

18. A leg press exercise machine, comprising:

a main frame having a front end and a rear end;

a user support having a primary portion and a secondary portion which are configured to support spaced positions on a user's body throughout an exercise;

a user support pivot mount which pivotally mounts the user support for rotation in a predetermined first rotational path about a user support pivot axis between a start position and an end position during a leg press exercise, the primary and secondary portions being fixed relative to one another and moving together in the same relative orientation to one another throughout the rotation of the user support along the predetermined rotational path;

at least one leg press exercise arm rotatably mounted relative to the main frame and having a foot engaging device which is configured for engagement by the feet of a user positioned on the user support to perform a leg press exercise, the leg press exercise arm being configured to move in a predetermined second rotational path between a start position and an end position during a leg press exercise movement;

a connecting linkage which links movement of the leg press exercise arm to movement of the user support, whereby rotation of the leg press exercise arm between the start and end position along the second rotational path simultaneously moves the user support between the start and end position of the first rotational path;

the entire foot engaging device being at a higher elevation than the primary portion and secondary portion of the user support at least in the start positions of the user support and leg press exercise arm;

a load which resists movement of at least one of the user support, exercise arm, and connecting linkage; and wherein all movement of the leg press exercise arm, connecting linkage and user support throughout an exercise is rotational.

19. An exercise machine configured for performance of lower body exercises only, comprising:

a main frame having a front end and a rear end;

a user support pivotally mounted relative to the main frame and configured to support a user in an exercise position and configured to move in a predetermined user support rotational path about a user support pivot axis between a start position and an end position during a lower body exercise, the user support having a primary portion and a secondary portion which are configured to support spaced positions on a user's body throughout an exercise, the primary and secondary portions being fixed relative to one another and moving together in the same relative orientation to one another throughout movement of the user support in the predetermined user support rotational path;

a single exercise arm rotatably mounted relative to the main frame, the single exercise arm comprising a lower body exercise arm configured to move in a predetermined exercise arm rotational path defining a lower body exercise and having a user engagement device configured for engagement by a lower body part of a user positioned on the user support to perform the lower body exercise;

the user engagement device being located at a higher elevation than the secondary portion of the user support through at least part of the exercise arm rotational path;

a connecting linkage which links movement of the lower body exercise arm to movement of the user support whereby rotation of the lower body exercise arm between a first position and a second position in the exercise arm rotational path simultaneously rotates the user support between a first position and a second position in the user support rotational path;

a load which resists movement of at least one of the user support, exercise arm, and connecting linkage; and wherein all movement of the lower body exercise arm, connecting linkage and user support throughout an exercise is solely rotational.

* * * * *

Disclaimer

7,988,603 B2 — Randall T. Webber, La Jolla, CA (US); Christopher E. Brennan, Santee, CA (US); Bruce Hockridge, San Diego, CA (US); Jeffrey O. Meredith, San Deigo, CA (US). LEG PRESS EXERCISE MACHINE WITH SELF-ALIGNING PIVOTING SEAT. Patent dated August 2, 2011. Disclaimer filed March 14, 2011, by the assignee Hoist Fitness Systems, Inc.

The term of this patent shall not extend beyond the expiration date of Pat. No. 7,594,880.

(*Official Gazette September 6, 2011*)